US005275223A

United States Patent [19]

Magro et al.

[11] Patent Number: 5,275,223

[45] Date of Patent: Jan. 4, 1994

[54] SUPPORT ROLLER PROVIDED WITH ROLL-UP MECHANISM FOR ROLLING DOORS, GATES AND THE LIKE

[76] Inventors: Sebastian Magro, 22 Hallock Meadow Dr., North; Vincent Magro, 44 Melvern Lane, both of Stonybrook, N.Y. 11790

[21] Appl. No.: 843,240

[22] Filed: Feb. 28, 1992

[51] Int. Cl.[5] ..... E05F 11/00

[52] U.S. Cl. ..... 160/191; 160/133; 160/316

[58] Field of Search ..... 160/191, 192, 133, 313, 160/315, 316, 317, 318, 323.1, 23.1

[56] References Cited

U.S. PATENT DOCUMENTS

| | | | |
|---|---|---|---|
| 1,081,202 | 12/1913 | Brunst | 160/133 |
| 1,132,830 | 3/1915 | Cole | 160/316 X |
| 1,968,719 | 7/1934 | Smurr | 160/133 |
| 2,540,742 | 2/1951 | Langer | 160/317 |
| 2,696,250 | 12/1954 | Michelman | 160/315 |
| 3,263,735 | 8/1966 | Vecchiarelli et al. | 160/67 X |
| 3,640,332 | 2/1972 | Luby et al. | 160/133 |
| 3,955,611 | 5/1976 | Coles et al. | 160/316 X |
| 4,519,434 | 5/1985 | Forquer | 160/133 |
| 4,633,927 | 1/1987 | Labelle | 160/133 |

*Primary Examiner*—David M. Purol

*Attorney, Agent, or Firm*—Goodman & Teitelbaum

[57] ABSTRACT

A support roller having a one-piece construction which can be cut to size to fit any sized doorway, with an outer perimeter of the support roller or flanges mounted on the support roller having a predetermined configuration to permit a rolling door, gate and the like to assume a substantially circular configuration when rolled up on the support roller, the support roller or each of the flanges being provided with a longitudinally extending recess therein and a longitudinally extending bulge portion thereon for securely mounting an end of the rolling door, gate and the like thereon, where the recess and the bulge portion of the support roller or a rail member provided within the support roller engages with collar portions of the roll-up mechanism to prevent relative rotation therebetween so that the support roller rotates with the collar portions The roll-up mechanism includes a coil spring mounted between the collar portions in such a manner that the innermost collar portion winds up the coil spring when the rolling door, gate and the like is being lowered to a closed position so that the coil spring counterbalances the weight of the door, gate and the like to permit the rolling door, gate and the like to be easily opened, where the roll-up mechanism is mounted within the support roller If required, additional coil springs can be added to the roll-up mechanism to counterbalance the weight of heavier rolling doors, gates and the like.

11 Claims, 5 Drawing Sheets

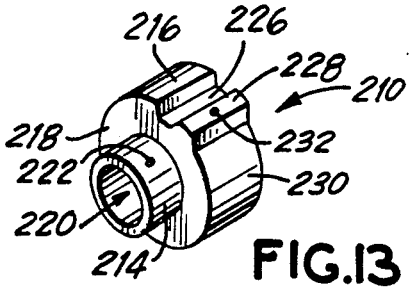
FIG.13
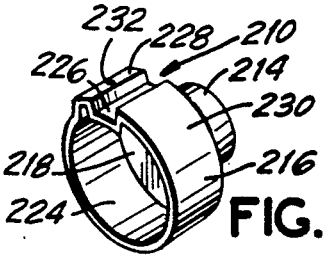
FIG.14
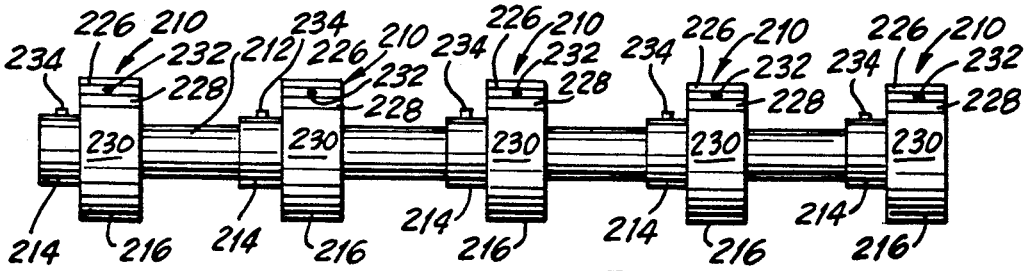
FIG.15
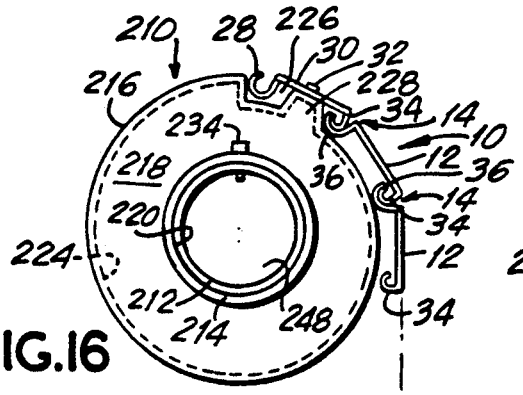
FIG.16
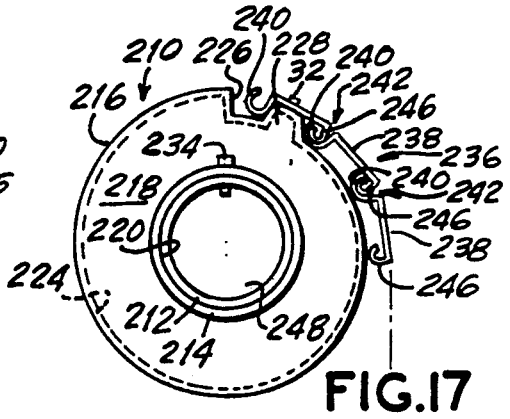
FIG.17
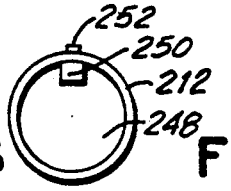
FIG.18
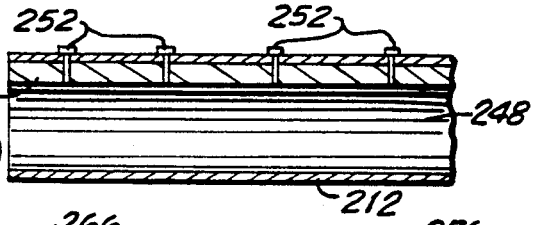
FIG.19
FIG.20
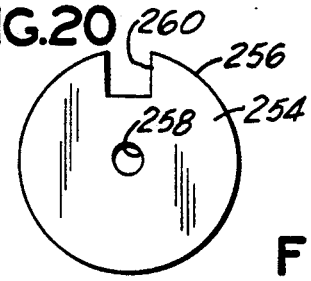
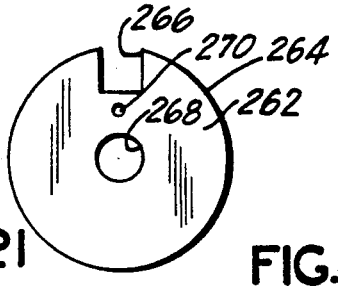
FIG.21
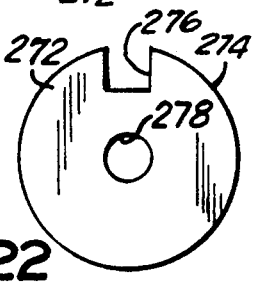
FIG.22

SUPPORT ROLLER PROVIDED WITH ROLL-UP MECHANISM FOR ROLLING DOORS, GATES AND THE LIKE

BACKGROUND OF THE INVENTION

This invention relates to rolling doors, gates and the like and, more particularly, to a support roller to which the rolling doors, gates and the like are secured for rolling up the doors, gates and the like to an opened position and for unrolling the doors, gates and the like down to a closed position, and to a roll-up mechanism provided within the support roller for counterbalancing the weight of the rolling doors, gates and the like when same are being rolled up to the opened position.

Support rollers having roll-up mechanisms for rolling doors, gates and the like are well known in the prior art, such as shown in U.S. Pat. No. 2,520,618 wherein the coil spring is mounted within the support roller. However, the hardware shown in this patent is very expensive and the assembly thereof is time consuming. The diameter of the support roller and the tension of the spring therein is dependent upon the width of the doorway and the weight of the door, gate and the like and, therefore, different diameter support rollers and springs must be stocked for use with the different sized doorways and different weighted doors, gates and the like, thereby increasing the cost of the inventory thereof.

As a matter of interest, U.S. Pat. No. 748,641 discloses an awning roller having a corrugated shape to receive and prevent rotation of a spring block therein while allowing the spring block to slide within the roller when the spring is being wound and unwound to accommodate the variation in the spring length.

U.S. Pat. No. 3,734,161 discloses a door construction having a support drum including end walls with stiffener members disposed therebetween which are shaped in the form of an involute and encircled by a sheet material rigidly secured thereto by fasteners in order to cause the panels of the rolling door to assume a substantially circular configuration when rolled upon the sheet material of the support drum. Here again, the end walls, stiffener members and the sheet material which form the drum are expensive and require a substantial amount of time to assemble.

U.S. Pat. No. 3,732,913 discloses a roll-up slotted shade assembly in which the spring disk and the bearing disk are secured within the barrel by means of screws.

U.S. Pat. No. 4,738,296 discloses a rolling steel door in which a spring module is removably secured within an outer cylinder to facilitate the removal and replacement of a broken or inoperative spring therein.

SUMMARY OF THE INVENTION

Accordingly, it is an object of the present invention to provide a support roller for rolling doors, gates and the like, which overcomes the disadvantages of the prior art support rollers.

Another object of the present invention is to provide a support roller as mentioned above, which has a one-piece construction and can be cut to the desired length to accommodate any sized doorway.

A further object of the present invention is to provide a support roller as mentioned above, which has an outer perimeter of a predetermined shape to cause the rolling doors, gates and the like to assume a substantially circular configuration when rolled up on the support roller.

Still another object of the present invention is to provide a support roller as mentioned above, which is provided with a longitudinally extending recess therein and a longitudinally extending bulge portion thereon for securely mounting the upper end of the rolling doors, gates and the like thereon.

Yet another object of the present invention is to provide a support roller as mentioned above, wherein the above-mentioned recess and bulge portion engage with collar portions of the roll-up mechanism to prevent the collars thereof from being rotated relative to the support roller so that the support roller rotates the collars therewith.

Yet another object of the present invention is to provide a support roller as mentioned above, which permits the roll-up mechanism to be easily mounted therein.

Another object of the present invention is to provide a support roller having flanges mounted thereon, which have outer perimeters of predetermined shapes to cause the rolling doors, gates and the like to assume a substantially circular configuration when rolled up on the support roller flanges.

A further object of the present invention is to provide a support roller with flanges as mentioned above, which are provided with longitudinally extending recesses therein and longitudinally extending bulge portions thereon for securely mounting the upper end of the rolling doors, gates and the like thereon.

Still another object of the present invention is to provide a support roller with or without the above mentioned flanges, which includes a rail member within the support roller for engaging with the collar portions of the roll-up mechanism to prevent the collar portions from being rotated relative to the support roller so that the support roller is rotated by some of the collar portions and rotates others of the collar portions therewith.

An added object of the present invention is to provide a support roller as mentioned above, wherein the roll-up mechanism is easily assembled together.

Another object of the present invention is to provide a support roller as mentioned above, which includes at least one coil spring and permits additional coil springs to be added to the roll-up mechanism to counterbalance the weight of normal and heavy rolling doors, gates and the like.

Yet another object of the present invention is to provide a support roller as mentioned above, wherein the support roller and the roll-up mechanism are simple and inexpensive to manufacture, and the assembly thereof is not time consuming.

These objects are achieved in accordance with the preferred embodiment of the present invention. Briefly, in accordance with the present invention, there is provided a roller having a one-piece construction which can be cut to size to fit any sized doorway. The outer perimeter of the support roller or flanges mounted on the support roller have a predetermined configuration to permit the rolling door, gate and the like to assume a substantially circular configuration when rolled up on the support roller. The support roller or each of the flanges is provided with a longitudinally extending recess therein and a longitudinally extending bulge portion thereon for securely mounting an end of the door, gate and the like thereon, where the recess and the bulge portion of the support roller or a rail member within the support roller engages with collar portion of the roll-up mechanism to prevent relative rotation therebetween so that the support roller rotates with the collars. The roll-up mechanism includes a coil spring mounted between the collars in such a manner that the innermost collar winds up the coil spring when the rolling door, gate and the like is being lowered to a closed position so that the coil spring counterbalances the weight of the door, gate and the like to permit the door, gate and the like to be easily opened. The parts of the roll-up mechanism are easily assembled together, and the roll-up mechanism is easily mounted within the support roller. If required, additional coil springs can be added to the roll-up mechanism to counterbalance the weight of heavier doors, gates and the like.

BRIEF DESCRIPTION OF THE DRAWINGS

With the above and additional objects and advantages in view, as will hereinafter appear, this invention comprises the devices, combinations and arrangements of the parts hereinafter described by way of example and illustrated in the accompanying drawing of preferred embodiments in which:

FIG. 13 is a perspective view of a support roller flange in accordance with the present invention;

FIG. 14 is a perspective view showing the opposite side of the support roller flange of FIG. 13;

FIG. 15 is an elevational view of a modified support roller having the support roller flanges of FIG. 13 mounted thereon;

FIG. 16 is a side elevational view of the modified support roller of FIG. 15, having an end of the rolling door secured thereto;

FIG. 17 is a side elevational view of the modified support roller similar to FIG. 16, having an end of a different rolling door secured thereto;

FIG. 18 is a side view of the support roller shown in FIG. 15, showing a further modification thereof;

FIG. 19 is a fragmented sectional view of the support roller of FIG. 18;

FIG. 20 is an enlarged front elevational view of a collar for placement within the support roller of FIGS. 18 and 19, being similar to the collar of FIG. 5;

FIG. 21 is an enlarged front elevational view of a further collar for placement within the support roller of FIGS. 18 and 19, being similar to the collar of FIG. 7; and FIG. 22 is an enlarged front elevational view of a still further collar for placement within the support roller of FIGS. 18 and 19, being similar to the collar of FIG. 8.

In the various figures of the drawings, like reference characters designate like parts.

DETAILED DESCRIPTION OF THE PREFERRED EMBODIMENTS

Figure 1:
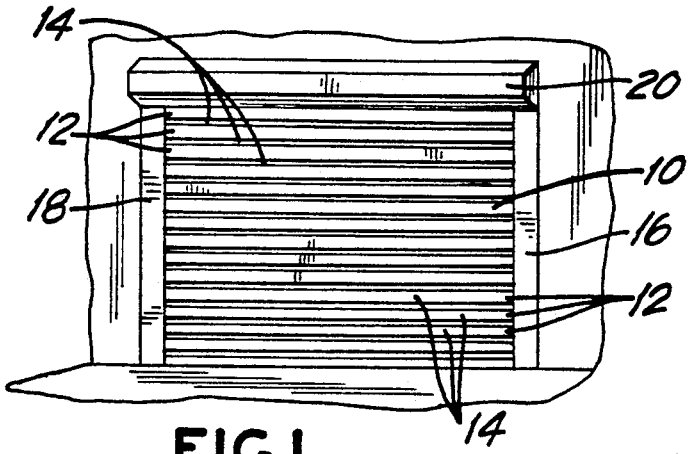
FIG. 1 is a fragmented perspective view illustrating a rolling door in a closed position.

Referring now to the drawings, FIG. 1 shows a rolling door 10 formed of a plurality of individual elongated slats 12 generally extending the width of the door. The slats 12 are interconnected by a hinge arrangement 14 which connects the adjacent slats together while permitting pivotal movement therebetween. The opposite ends of the slats 12 are protected by side guard rails 16, 18 in which there are contained conventional vertically disposed track arrangements along which the slats can ride up and down. At the upper end of the doorway, there is a projecting conventional header 20 which contains the support roller and the roll-up mechanism in accordance with the present invention for raising or lowering the rolling door 10, which will be discussed in detail below.

Figure 2:
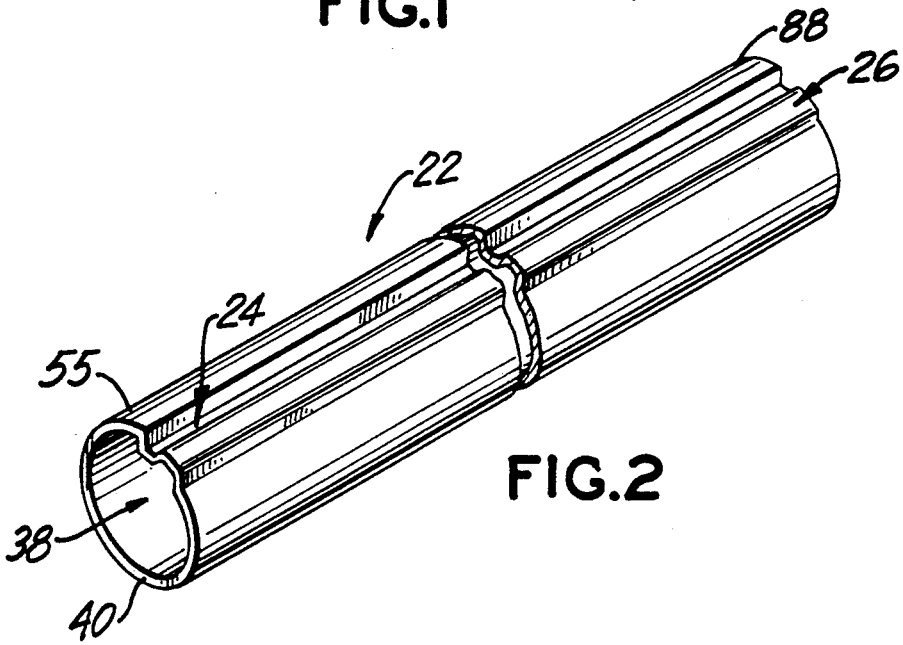
FIG. 2 is a fragmented perspective view of a support roller in accordance with the present invention.

FIG. 2 shows the support roller 22 of the present invention, which is horizontally mounted within the header 20 for rolling up and unrolling the rolling door 10. The support roller 22 has a one-piece construction and can be cut to the desired length to accommodate any sized doorway. The support roller 22 is provided with an elongated recess 24 formed longitudinally along the support roller 22. A bulge portion 26 is also formed longitudinally along the support roller 22, being adjacent and parallel to the recess 24, the function of which will be described below.

Figure 3:
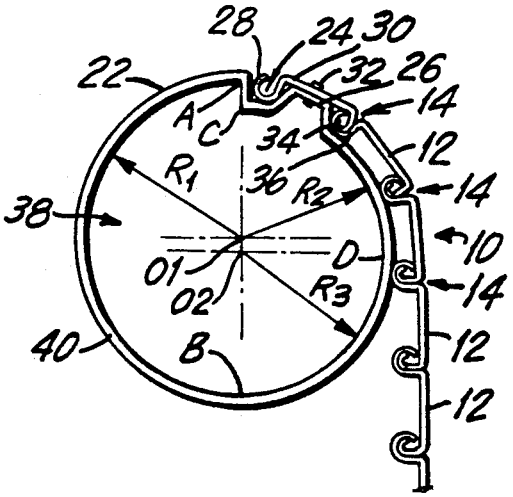
FIG. 3 is a fragmented side elevational view of the support roller shown in FIG. 1, having an end of the rolling door secured thereto.

As shown in FIG. 3, the hinge portion 28 of the hinge arrangement 14 of the uppermost slat 12, designated slat 30, is disposed within the recess 24 of the support roller 22. The slat 30 rests on the upper surface of the bulge portion 26 and is secured thereto by fastening means 32, such as screws, bolts, rivets and the like. The opposite hinge portion 34 of slat 30 is pivotly interlocked with the hinge portion 36 of the adjacent slat 12 to form the hinge arrangement 14 which sits on the opposite side of the bulge portion 26 so that the slat 30 is securely mounted on the bulge portion 26.

As shown, the support roller 22 has a tubular configuration to provide an opening 38 extending therethrough for receiving the roll-up mechanism therein, as will be explained below. The wall 40 of the support roller 22 around the opening 38 is not circular, but is rather formed by radii having different lengths and even different center points. As shown in FIG. 3 the radius R1 has a center point 01 and forms the wall 40 from point A to point B which extends for approximately 180°. A second radius R2 has a shorter length that the radius R1, the difference therebetween being equal to approximately the depth of the recess 24. The radius R2 has the same center point 01 and extends for approximately 90° from point C, which is directly below point A, to point D with the portion at the bulge portion 26 being omitted. The third radius R3 has a length slightly larger than radius R2 but less than radius R1. The radius R3 has a center point 02 disposed below the center point 01 so that the radius R3 can provide a smooth curve to the wall 40 for approximately 90° from point D to point B. The reason for forming the wall 40 with the different radii R1, R2 and R3 will now be discussed below.

Figure 4:
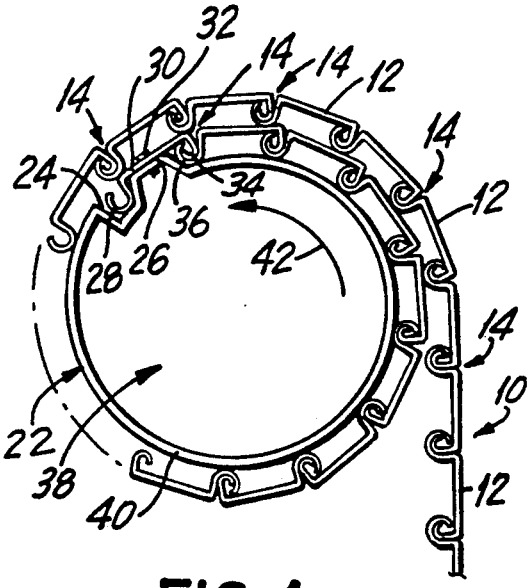
FIG. 4 is a fragmented side elevational view similar to FIG. 3, showing the support roller rolling up the rolling door.

As shown in FIG. 4, when the support roller 22 is rotated in a counterclockwise direction as indicated by the arrow 42, where the rotating means will be explained below, the support roller 22 rolls up the door 10 thereon so that the door 10 is raised. The construction of the wall 40, as mentioned above, causes the slats 12 of the door 10 to assume a substantially circular configuration when rolled up on the wall 40 of the support roller 22. Accordingly, due to the shape of the wall 40, the slats 12 rolled up on the wall 40 will have a specific center of gravity. This center of gravity will remain substantially constant at one specific point no matter how many slats 12 are rolled up on the support roller 22, where the center of gravity when the door 10 is in its lowest closed position will be substantially the same as the center of gravity when the door 10 is in its raised opened position. Because the center of gravity is substantially constant, the rotation of the support roll 22 is smoothly performed to reduce the wear and tear on the means rotating the support roller 22, and any jerky movements in the rotation of the support roller 22 are avoided. Furthermore, because the weight of the rolled up door 10 on the support roller 22 is evenly distributed due to the substantially constant center of gravity, unwarranted stresses and fatigue strain on the support roller 22 are substantially eliminated. Thus, the configuration of the wall 40 which permits the rolled up slats 12 to assume a substantially circular configuration is a desirous feature of the present invention.

Figure 5:
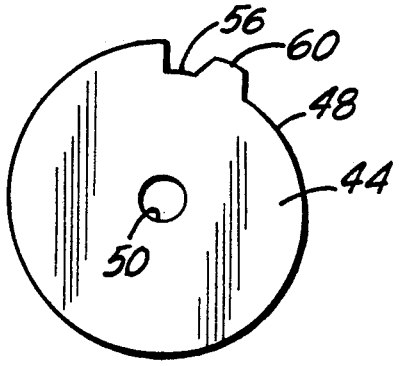
FIG. 5 shows an enlarged front elevational view of a collar for placement within the support roller of FIG. 2.
Figure 6:
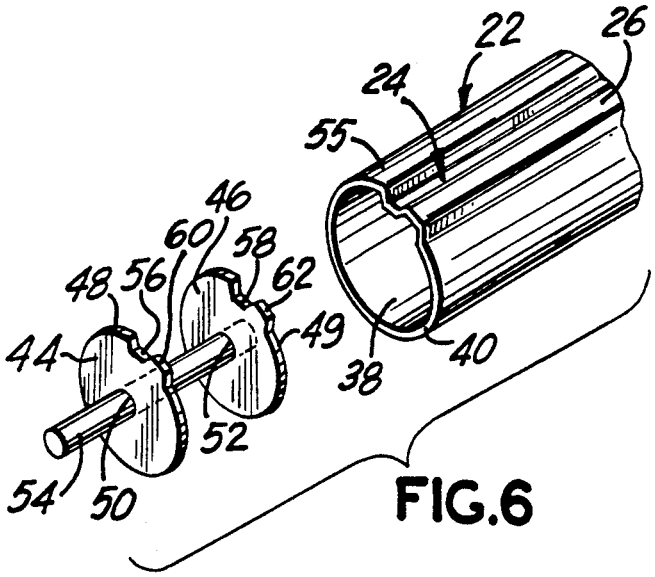
FIG. 6 is a fragmented perspective view showing a pair of collars, as shown in FIG. 5, being positioned for placement within the support roller.

FIG. 5 shows a collar 44, which with an identical collar 46, shown in FIG. 6, forms a pair of collars for rolling up the door 10. The collars 44, 46 each have an outer peripheral edge 48, 49 which matches the interior surface of the wall 40 defining the opening 38. The collars 44, 46 are provided with centrally located openings 50, 52, respectively, therein for receiving a shaft 54 which has an outer surface corresponding to the size of the collar openings 50, 52. The collars 44, 46 are secured on the shaft 54 in a spaced apart relationship, with the shaft 54 passing through the collar openings 50, 52, as shown in FIG. 6, where the securement therebetween can be made by any suitable means, such as a force-fit arrangement therebetween, welding and the like. As shown in FIG. 6, the shaft 54 with the collars 44, 46 disposed thereon is positioned for insertion into one end 55 of the support roller 22, where the recesses 56, 58 in the edges 48, 49 of the collars 44, 46 are in alignment with the recess 24 in the support roller 22. Furthermore, the projections 60, 62 on the edges 48, 50 of the collars 44, 46 are also in alignment with the bulge portion 26 on the support roller 22. The function of the collars 44, 46 and the shaft 54, which form parts of the rotation means, will be set forth below.

Figure 7:
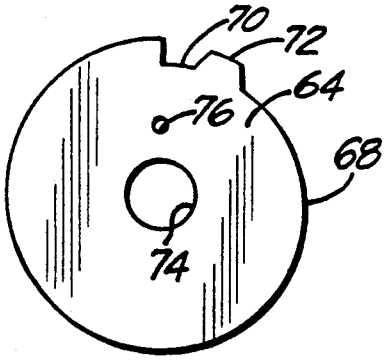
FIG. 7 is an enlarged front view of a further collar for placement within the support roller.

FIG. 7 shows a further collar 64 having an outer peripheral edge 68 which matches the edges 48, 49 of the collars 44, 46 to also match the interior surface of the wall 40 defining the opening 38. Here again, the edge 68 includes a recess 70 therein, the same as recesses 56, 58 of the collars 44, 46, and a projection 72 thereon the same as projections 60, 62 of the collars 44, 46. The centrally located opening 74 of the collar 68 is larger than the openings 50, 52 of the collars 44, 46, as will be explained below. Furthermore, a small opening 76 extends through the collar 64, being offset from the opening 74 where the function thereof will also be explained below.

Figure 8:
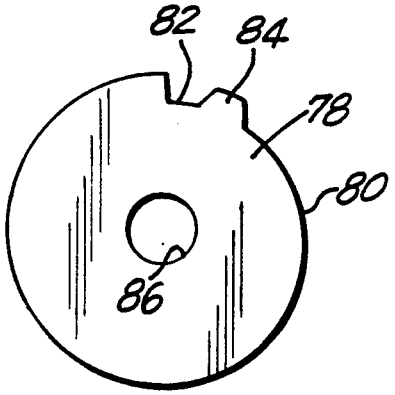
FIG. 8 is an enlarged view of a still further collar for placement within the support roller.

FIG. 8 shows a still further collar 78 which is identical to collar 64 shown in FIG. 7 except collar 78 does not include the small offset opening 76 provided in the collar 64. Accordingly, the collar 68 includes an edge 80, a recess 82 in the edge 80, a projection 84 on the edge 80 and a centrally located opening 86, which match the corresponding portions of the collar 64. The function of collar 78 will also be explained below.

Figure 9:
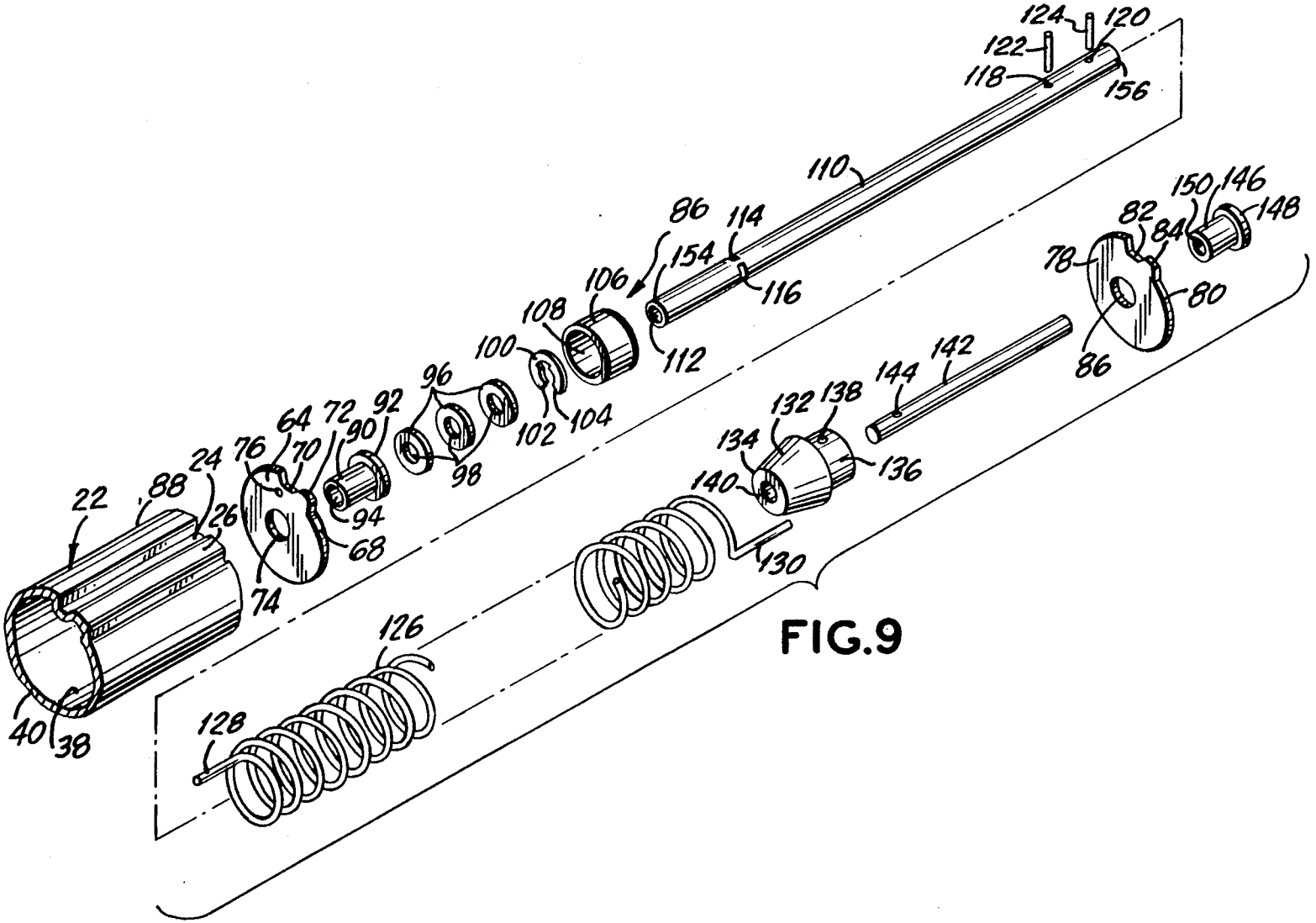
FIG. 9 is a fragmented exploded view of the parts of the roll-up mechanism which includes the collars of FIGS. 7 and 8.

FIG. 9 shows parts of the roll-up mechanism 86, including the collars 64, 78 of FIGS. 7 and 8, which are insertable into the opposite end 88 of the support roller 22, where the recesses 70, 82 in the edges 68, 80 of the collars 64, 78 are in alignment with the recess 24 in the support roller 22. Furthermore, the projections 72, 84 of the collars 64, 78 are also in alignment with the bulge portion 26 of the support roller 22.

The additional parts of the roll-up mechanism 86 include a bushing 90 having an enlarged head 92 at one end thereof and an opening 94 extending therethrough. The bushing 90 is insertable into the opening 74 of the collar 64, where the enlarged head 92 of the bushing 90 cannot pass through the opening 74 in the collar 64. Approximately three washers 96 are provided having openings 98 therethrough, where the size of the openings 98 are the same size as the opening 94 through the bushing 90. A C-shaped clamp 100 is also provided having opposing insert parts 102, 104 as will be explained below. A cap member 106 is also provided having a recess 108 therein for engaging over and onto the enlarged bushing head 92, the washers 96 and the C-shaped clamp 100, as set forth below. The cap member 106 has an opening 109, shown in FIG. 10, extending through the top wall, being the same size as the above-mentioned openings 94, 98.

As shown in FIG. 9, the roll-up mechanism 86 also includes an elongated hollow tubular bar 110 having an opening 112 extending therethrough. The bar 110 has opposing cutouts 114, 116 extending therethrough on opposite sides thereof at one end of the bar 110, and a pair of spaced apart holes 118, 120 extending through the bar 110 adjacent the opposite end of the bar 110 for receiving pins 122, 124, respectively, as set forth below. A coil spring 126 is also shown, having a straight wire end 128 and an opposite straight wire end 130.

A bushing 132 is also provided having a frustum-shaped head portion thereon which tapers outwardly from the end 134, and a cylindrical portion 136 having an outer diameter slightly less than the inner diameter of the coil spring 126. An opening 138 is provided transversely through the cylinder portion 136, and an opening 140 is provided longitudinally through the bushing 132. The bushing opening 140, as well as the above mentioned bushing opening 94, washer openings 98 and cap member opening 108, are approximately the same as the outer surface of the bar 110.

A shaft 142, which is similar to the above mentioned shaft 54, has an opening 144 extending transversely therethrough, the shaft 142 being associated with a further bushing 146 having an enlarged head 148 and an opening 150 extending longitudinally therethrough. The bushing opening 150 is approximately the same size as the outer surface of the shaft 142, and the outer surface of the bushing 146 is approximately the same size as the opening 86 in the collar 78, where the head 148 of the bushing 146 is larger than the opening 86, as will be explained below.

Figure 10:
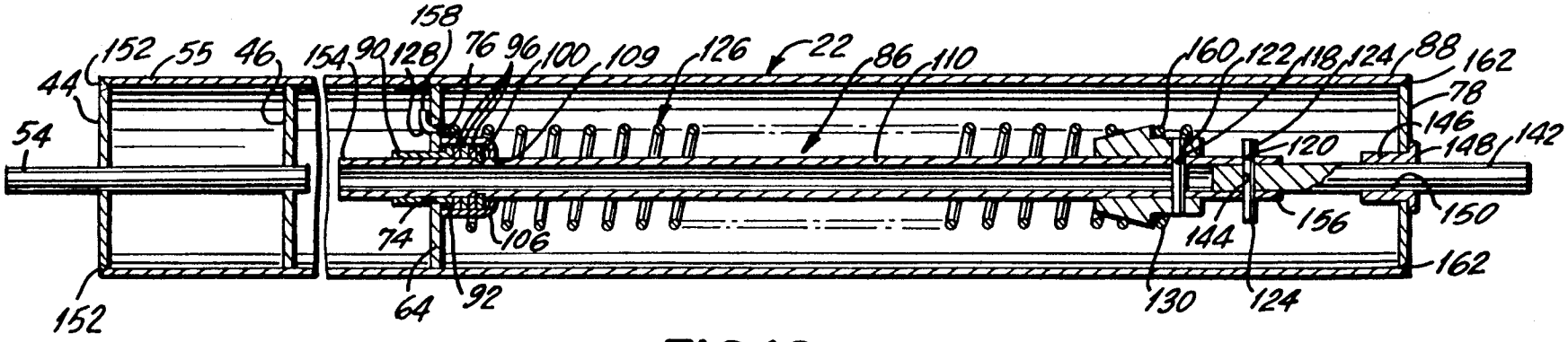
FIG. 10 is a fragmented side cross-sectional view of the assembled roll-up mechanism disposed within the support roller.

With reference to FIGS. 6, 9 and 10, the assembly of the roll-up mechanism 86 within the support roller 22 will now be described. The first step is to cut the one-piece support roller 22 to a predetermined length corresponding to the width of the doorway so that it can accommodate thereon the slats 12 forming the rolling door 10 which closes the doorway as shown in FIG. 1. The predetermined length of the support roller 22 should also be sized to fit horizontally within the header 20. After the support roller 22 has been cut, the parts of the rotation means including the collars 44, 46, which are securely mounted on the shaft 54 as shown in FIG. 6, are inserted into the end 55 of the support roller 22 so that the recesses 56, 58 in the edges 48, 49 of the collars 44, 46 are in alignment with the recess 24 in the support roller 22, and so that the projections 60, 62 on the edges 48, 49 of the collars 44, 46 are also in alignment with the bulge portion 26 on the support roller 22.

Once inserted as shown in FIG. 10, rotation of the shaft 54 will cause the collars 44, 46 to rotate therewith, which in turn will cause the support roller 22 to also rotate therewith. In the inserted position, the collar 44 is secured to the end 55 by spot welds 152 around the perimeter thereof so that longitudinal horizontal movement between the shaft 54 and the collars 44, 46 thereon relative to the support roller 22 is prevented, whereby a unitary construction is provided therebetween.

The roll-up mechanism 86 is now assembled. The small end of the bushing 90 is inserted into the opening 74 of the collar 64 until the bushing head 92 abuts against the side of the collar 64. The end 154 of the bar 110 is inserted through the opening 109 of the cap member 106 until the cap member 106 is positioned past the cutouts 114, 116. The C-shaped clamp 100 is secured on the bar 110 with the insert parts 102, 104 engaging in the cutouts 114, 116 of the bar 110 for securement therebetween. The end 154 of the bar 110 is now inserted through the openings 98 of the washers 96 until the washers 96 abut against the C-shaped clamp 100. The end 154 of the bar 110 is now inserted into and through the opening 94 of the bushing 90, which has the collar 64 thereon so that the bushing head 92 abuts against the washers 96.

The cap member 106 is now forced back over the C-shaped clamp 100, the washers 96 and the bushing head 92 so that the C-shaped clamp 100, the washers 96 and the bushing head 92 are securely contained within the recess 108 of the cap member 106 in a forced fit engagement. Thus, the collar 64, the bushing 90, the washers 96, the C-shaped clamp 100 and the cap member 106 are secured on the bar 110 in such a manner that the collar 64, by means of the bushing 90, can rotate relative to the bar 110, as will be explained below.

The opposite end 156 of the bar 110 is now inserted through the end of the coil spring 126 having the straight wire end 128 thereon. The straight wire end 128 is inserted through the opening 76 of the collar 64. After insertion, the straight wire end 128 is bent to provide an offset portion 158, as shown in FIG. 10, so that the end of the coil spring 120 is secured to the collar 64. The end 156 of the bar 110 is now inserted through the bushing opening 140, the end 134 of the bushing 132 being inserted through first, until the end 134 is positioned in the opposite end of the coil spring 126, as shown in FIG. 10.

The transverse bushing opening 138 is now aligned with the transverse hole 118 in the bar 110, and the pin 122 is inserted in a force-fit into the bushing opening 138 and through the bar hole 118 to secure the bushing 132 to the bar 110. The opposite straight wire end 130 of the spring 126 is now clamped around the cylindrical portion 136 of the bushing 132 to form a securement coil 160 behind the frustum-shaped head portion of the bushing 132 to secure the opposite end of the coil spring 126 to the bushing 132 in such a manner that the securement coil 160 is not free to rotate relative to the bushing 132.

Thus, the ends of the coil spring 126 are secured, one end being secured to the collar 64 and the opposite end being secured to the bushing 132, where in this arrangement, the collar 64 is prevented from being pulled off the end 154 of the bar 110, and the C-shaped clamp 100 prevents the collar 64 from being moved towards the opposite end 156 of the bar 110, so that the collar 64 is securely positioned on the bar 110 for rotation relative to the bar 110.

The end of the shaft 142 having the opening 144 adjacent thereto is now inserted into the end 156 of the bar 110 and through the opening 112 extending through the bar 110 until the shaft opening 144 is in alignment with the transverse hole 120 in the bar 110. The pin 124 is now inserted in a force-fit through the bar hole 120 and the shaft opening 144 to secure the shaft 142 to the bar 110. The bushing 146 is now inserted into the opening 86 of the collar 78 until the bushing head 148 abuts against the side of the collar 78. The free end of the shaft 142 is now inserted into the smaller end of the bushing 146 and through the opening 150 of the bushing 146 so that the collar 78 is mounted on the shaft 142, as shown in FIG. 10. Thus, the collar 78 is secured on the shaft 142 in such a manner that the collar 78, by means of the bushing 146, can rotate relative to the shaft 142, as will be explained below.

The roll-up mechanism 86 is now ready to be inserted into the end 88 of the support roller 22. The collar 64 is rotated so that the collar recess 70 is in alignment with the recess 24 in the support roller 22, and so that the collar projection 72 is in alignment with the bulge portion 26 on the support roller 22, and then the roll-up mechanism 86 is inserted into the support roller 22 with the support collar 64 being the first collar inserted.

During the insertion, when the collar 78 is adjacent to the end 88 of the support roller 22, the collar 78 is rotated so that the collar recess 82 is in alignment with the recess 24 in the support roller 22, and so that the collar projection 84 is also in alignment with the bulge portion 26 on the support roller 22. Once inserted as shown in FIG. 10, the collar 78 is secured to the end 88 of the support roller 22 by spot welds 162 around the perimeter thereof so that the collar 78 and the support roller 22 are secured together to provide a unitary construction therebetween to maintain the roll-up mechanism 86 within the support roller 22.

The rolling door 10 is now secured to the support roller 22 in the manner mentioned above, and the support roller 22 with the rolling door 10 secured thereon is mounted in a conventional manner in the header 20. The free end of the shaft 54 is connected to conventional turning means, such as shown in U.S. Pat. No. 4,738,296, in order to rotate the shaft 54 to open and close the rolling door 10.

The free end of the shaft 142 is secured to conventional adjustable securing means, for example, such as also shown in U.S. Pat. No. 4,738,296, in order to normally prevent the rotation of the shaft 142 but to only allow, when required, the shaft 142 to be rotated in order to adjust the spring tension, as further set forth in U.S. Pat. No. 4,738,296. Thus, with the rolling door 10 in the closed position, the shaft 142 is rotated in order to adjust the spring tension until the rolling door 10 is just about to rise, thus counterbalancing the weight of the rolling door 10. After the adjustment, the adjustable securing means is locked in place so that the shaft 142 can no longer be rotated, such as when the shaft 54 is rotated.

In view of the above, when opening the rolling door 10, the turning means is used in a conventional manner to rotate the shaft 54, which in turn rotates the collars 44, 46 to rotate the support roller 22 to roll up the rolling door 10 thereon into an opened position. During this opening procedure, the coil spring 126, which is in a tensioned wound up position as mentioned above, counterbalances the weight of the rolling door 10 so that the amount of force required to rotate the shaft 54 in order to roll up the door 10 is thereby reduced to facilitate the raising of the rolling door 10. It is noted, that during the opening procedure, the collar 64 rotates with the support roller 22 to permit the coil spring 126 to unwind.

Upon closing the rolling door 10, the support roller 22 rotates in an opposite direction and also rotates the collar 64 therewith. In view of the fact that the bar 110 is held stationary and the bushing 132 thereon is also held stationary, the securement coil 160 clamped on the bushing 132 is also held stationary while the opposite end of the coil spring 126, which has the offset portion 158 secured to the collar 64, is being rotated by the collar 64 to wind up the coil spring 126. Thus, when the rolling door 10 is fully closed, the coil spring 126 is again tensioned to counterbalance the weight of the rolling door 10. The above procedures are repeated every time the rolling door 10 is opened and closed.

In some cases, especially when the rolling door 10 is very heavy, the single coil spring 126 is not capable of counterbalancing the weight of the rolling door 10. Accordingly, at least two or more coil springs are required to counterbalance the weight of the rolling door 10. Described below are two ways of adding an additional or more coil springs.

Figure 11:
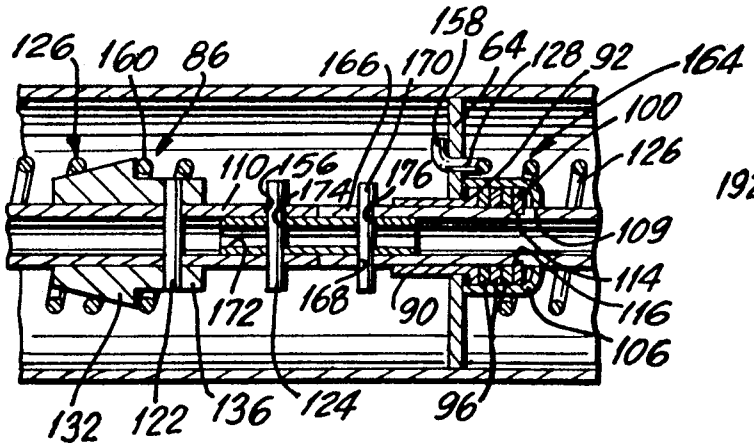
FIG. 11 is a fragmented side cross-sectional view of a modified roll-up mechanism.

FIG. 11 shows the support rolled 22 provided with the above-mentioned roll-up mechanism 86 and a second roll-up mechanism 164 in a series arrangement therewith. Accordingly, the same parts as described above are used, however, the above-mentioned bar 110 is modified, as added bar 166, to include a hole 168 therethrough to receive an additional pin 170. A tubular connecting member 172 is also used, the connecting member 172 having holes 174 and 176 therein.

Accordingly, the connecting member 172 is used at the connection location in place of the shaft 142, and is placed into the bar 110 until the holes 146 and 174 are in alignment and thereafter, the pin 124 is force-fit through the holes 146, 174 to secure the connecting member 172 to the bar 110. Likewise, the other end of the connecting member 172 is inserted into the added bar 166 so that the holes 168 and 176 are in alignment and thereafter, the pin 170 is inserted in a force-fit through the holes 168, 176 to secure the connecting member 172 to the added bar 166. Thus, the bars 110 and 166 are connected together.

It is noted, that the parts to the left of the pin 124 in FIG. 11 are the same as the parts to the left of the pin 124 in FIG. 10. Furthermore, the parts to the right of the pin 170 in FIG. 11 are the same as the parts shown to the right of the bushing 90 in FIG. 10. Accordingly, the roll-up mechanisms 86, 164 shown in FIG. 11 work together in the same manner as the above-mentioned single roll-up mechanism 86 shown in FIG. 10, so that a further explanation of the function thereof is not necessary, it being understood that both bars 110 and 166 are held stationary in the manner set forth above.

Figure 12:
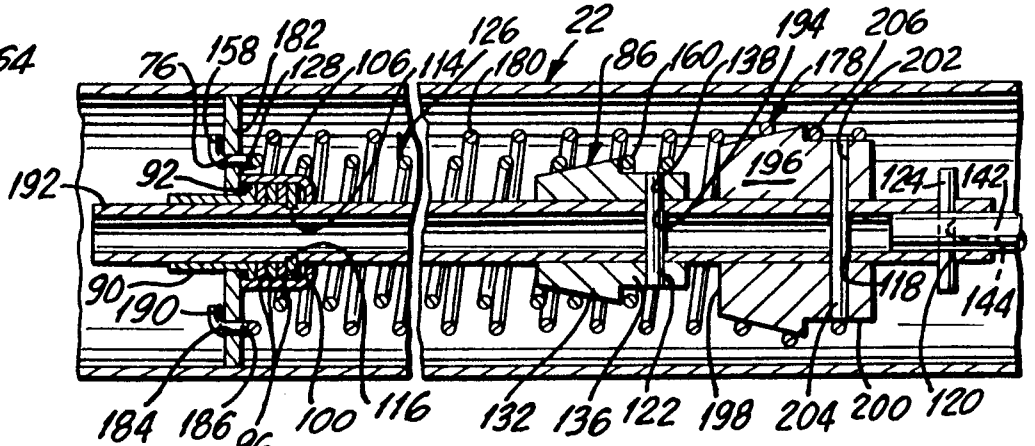
FIG. 12 is a fragmented side cross-sectional view of a still further modified roll-up mechanism.

FIG. 12 shows the support roller 22 provided with the above-mentioned roll-up mechanism 86 and a second roll-up mechanism 178 in a parallel arrangement therewith. Accordingly, the same parts as described above are mostly used, however, a second larger coil spring 180 of the roll-up mechanism 178 is disposed around the roll-up mechanism 86. The above-mentioned collar 64 is modified and replaced by a similar collar 182 in order to provide a second offset opening 184 therethrough to receive the straight wire end 186 of the coil spring 180 therethrough. In the manner mentioned above, the straight wire end 186 is bent to provide an offset portion 190 so that the end of the coil spring 180 is secured to the collar 182. In the same manner as mentioned above, the coil spring 126 is also secured to the modified collar 182.

The bar 110 is also modified and replaced by a similar bar 192 in order to include a third hole 194 therethrough. The transverse opening 138 of the bushing 132 is positioned in alignment with the bar hole 194, and the above-mentioned pin 124 is inserted in a force-fit therein to secure the bushing 132 on the bar 192.

A bushing 196 is also provided, being similar but larger than bushing 132, and having a frustum-shaped head portion thereon which tapers outwardly from the end 198, and a cylindrical portion 200 having an outer diameter slightly less than the inner diameter of the coil spring 180. A transverse opening 202 is provided through the cylindrical portion 200 and is positioned in alignment with the bar hole 118, where a longitudinal opening is also provided through the bushing 196 to receive the bar 192 therethrough. In the same manner as mentioned above, the frustum-shaped head portion of bushing 196 is disposed into the opposite end of the coil spring 180, and a pin 204 is inserted in a force-fit through the bushing opening 202 and the bar hole 118 to secure the bushing 196 to the bar 192.

Here again, the opposite straight wire end of the coil spring 180 is clamped around the cylindrical portion 200 of the bushing 196 to form a securement coil 206 behind the frustum-shaped head portion of the bushing 196 to secure the opposite end of the coil spring 180 to the bushing 196 in such a manner that the securement coil 206 is not free to rotate relative to the bushing 196. Thus, the opposite ends of the coil spring 180 are secured, one end being secured to the modified collar 182 and the opposite end being secured to the bushing 196. In this arrangement, the modified collar 182 is prevented from being pulled off the end of the bar 192 by both the coil springs 126 and 180, and yet is free to rotate relative to the bar 192. Accordingly, the roll-up mechanisms 86, 178 shown in FIG. 12 work together in the same manner as the above-mentioned single roll-up mechanism 86 shown in FIG. 10, so that a further explanation of the function thereof is not necessary.

FIGS. 13 and 14 show a support roller flange 210, a selected number of which are mounted on a conventional prior art support roller 212, as shown in FIG. 15, to modify same to function in the same manner as the above-mentioned support roller 22, as set forth below. The support roller flange 210 has a one-piece construction including a small tubular portion 214 and a large tubular portion 216 connection together by a side wall 218. The small tubular portion 214 has an opening 220 extending therethrough, the opening 220 having a diameter corresponding to the diameter of the outer surface of the support roller 212 so that the support roller 212 can be received in the opening 220 of the tubular portion 214. Additionally, a hole 222 is provided through the outer surface of the tubular portion 214, the function of which is explained below.

As shown in FIG. 14, the large tubular portion 216 has a large opening 224 therein communicating with the smaller opening 220 in the small tubular portion 214 so that the support roller 212 can pass therethrough. The large tubular portion 216 is provided with a longitudinally extending recess 226 and a bulge portion 228 adjacent and parallel to the recess 226. It is noted, that the recess 226 and the bulge portion 228 are similar to the above-mentioned recess 24 and bulge portion 26, and function in the same manner.

Furthermore, the tubular configuration of the wall 230 of the large tubular portion 216 is not circular, but is rather formed in the same manner as the above-mentioned wall 40 of the support roller 22 for the same reasons set forth above, to permit the rolling door to assume a substantially circular configuration when rolled up on the support roller flanges 210, so that a further explanation thereof is not thought necessary. Additionally, a hole 232, which may be threaded, is formed through the bulge portion 228, the function of which is explained below.

Referring now to FIG. 15, a number of support roller flanges 210 are mounted on the support roller 212 in an equally spaced apart arrangement with one support roller flange 210 being mounted on each opposite end of the support roller 212. In each case, a bolt, screw or rivet 234 is passed through the hole 222 in the tubular portion 214, and through an aligned associated hole provided in the support roller 212 to secure the support roller flange 210 to the support roller 212 in a conventional manner so that the support roller flanges 210 are in a predetermined position on the support roller 212 with the recesses 226 being in alignment with each other, and also its bulge portions 228 being in alignment with each other. The above-mentioned rolling door 10 is now secured to the support roller flanges 210 in the same manner as set forth above, and as shown in FIGS. 16 and 17 as set forth below.

As shown in FIG. 16, the hinge portion 28 of the above-mentioned hinge arrangement 14 of the uppermost slat 12, designated slat 30, of the rolling door 10 is disposed within the recess 226 of the conventional support roller 212. The slat 30 rests on the upper surface of the bulge portion 228 and is secured by fastening means 32, such as screws, bolts, rivets and the like, passing through the hole 232 in the bulge portion 228. The opposite hinge portion 34 of the slat 30 is pivotly interlocked with the hinge portion 36 of the adjacent slat 12 to form the hinge arrangement 14 which sits on the opposite side of the bulge portion 228 so that the slat 30 is securely mounted on the hinge portion 228 in the same manner as mentioned above.

It is noted, that the slats of rollings doors do not always have the same width, where FIG. 17 shows a rolling door 236 having slats 238 which are not as wide as the slats 12 of the above-mentioned rolling door 10. Accordingly, the bulge portion 228 is made narrow enough and the recess 226 is made wide enough to accommodate both the wide slats 12 and the narrow slats 238. Thus, as shown in FIG. 17, the hinge portion 240 of the hinge arrangement 242 of the uppermost slat 238, designated slat 244, is disposed within the recess 226 of the support roller flange 210. The slat 244 rests on the upper surface of the bulge portion 228 and is secured thereto by the fastening means 32, such as screws, bolts, rivets and the like, passing through the hole 232 in the bulge portion 228. The opposite hinge portion 246 of the slat 244 is pivotly interlocked with the hinge portion 240 of the adjacent slat 238 to form the hinge arrangement 242 which sits on the opposite side of the bulge portion 228 so that the slat 244 is securely mounted on the bulge portion 228.

As indicated in FIGS. 15, 16 and 17, the conventional prior art support roller 212 is an elongated tubular member having a circular outer surface, in cross section, with an opening 248 extending longitudinally therethrough. Accordingly, the prior art spring loaded roll-up mechanism (not shown) can be mounted within the opening 248 of the support roller 212 for counterbalancing the weight of the rolling door when same is being rolled up to the open position, which is well known in the art. Therefore, the modified support roller 212 having the support roller flanges 210 thereon can either be used with the prior art roll-up mechanism or can be used with the rotation means and roll-up mechanism 86 of the present invention. If the rotation means and roll-up mechanism 86 are used, then modifications to the support roller 212 and to the collars of the rotation means and roll-up mechanism 86 are required as set forth below.

FIGS. 18 and 19 show the support roller 212 modified to include a rail member 250 mounted within the opening 248. The rail member 250 is in the form of an elongated bar, being substantially square shaped with one side thereof having a slight curvature to match the curvature of the interior wall of the support roller 212. The curved side of the rail member 250 is disposed against the interior wall surface of the support roller 212, and is secured thereto by conventional means 252, such as screws, bolts, rivets and the like.

Additionally, the collars 44, 46, 64 and 78 of the rotation means and roll-up mechanism 86 are modified in order to co-act with the rail member 250 to prevent relative rotation therebetween. Thus, FIG. 20 shows a collar 254 which, with an identical collar, replaces collars 44, 46 of FIGS. 5 and 6 for rolling up the door. Both collars 254 have a circular outer peripheral edge 256 to match the interior wall surface around the opening 248 of the support roller 212. Each collar 254 is also provided with a centrally located opening 258 to receive the above-mentioned shaft 54 therein, in the same manner and for the same function as mentioned above. Furthermore, each collar 254 was a square shaped recess 260 in the edge 256 thereof to receive the rail member 250 of the support roller 212 therein so that the collars 254 and the shaft 54 form parts of the rotation means, as set forth above. It is noted, that the recess 260 in the collar 254 has the same shape and size as the rail member 250 so that the collar 254 rotates the support roller 212 therewith.

Likewise, FIG. 21 shows a collar 262 which replaces the collar 64 of FIG. 7. The collar 262 has a circular outer peripheral edge 264 which matches the edges of the collars 254 to also match the interior wall surface around the opening 248 of the support roller 212. Here again, the edge 264 includes a square shaped recess 266 therein, being the same shape and size as the recesses 260 of the collars 254 to receive the rail member 250 of the support roller 212 therein, so that the support roller 212 rotates the collar 262 therewith. The collar 262 is provided with a centrally located opening 268 which is larger than the openings 258 of the collars 254, where the opening 268 receives the bushing 90 therein in the same manner as set forth above. Furthermore, a small opening 270 extends through the collar 262, being offset from the opening 268, where the small opening 270 functions in the same manner as the small opening 76 in the collar 64 to receive the wire end 128 of the coil spring 126 of the roll-up mechanism 86 therein as mentioned above.

Furthermore, FIG. 22 shows a further collar 272 which replaces the collar 78 of FIG. 8. The collar 272 is identical to collar 262 shown in FIG. 21 except collar 272 does not include the small offset opening 270 provided in the collar 262. Accordingly, the collar 272 includes an edge 274, a recess 276 in the edge 274 to receive the rail member 250 so that the support roller 212 rotates the collar 272 therewith, and a centrally located opening 278, which match the corresponding portions of the collar 262. The opening 278 receives the above mentioned bushing 146 of the roll-up mechanism 86 therein to function in the same manner as the replaced collar 78.

Thus, with the above-mentioned modifications, the rotation means and roll-up mechanism 86 can be used within the support roller 212 to function in the same manner as mentioned above, where no further explanation thereof is thought necessary.

Numerous alterations of the structures herein disclosed will suggest themselves to those skilled in the art. However, it is understood that the present disclosure relates to preferred embodiments of the invention which are for the purposes of illustration only, and are not to be construed as limitations of the invention.

What is claimed is:

1. A support roller on which a door and the like is rolled up and unrolled between an opened position and a closed position, comprising:

an elongated tubular member having an opening extending longitudinally therethrough to receive a spring loaded roll-up mechanism therein for counterbalancing the weight of the door when the door is being rolled up to the opened position, and to also receive rotation means therein for rolling up and unrolling the door;

first recess means for receiving a hinge portion of an uppermost slat of the door;

first bulge means for engaging the uppermost slat and providing a surface for securing the uppermost slat thereto;

second recess means for:

engaging first portions of the roll-up mechanism for rotation therewith, said second recess means being disposed in the first portions to prevent relative rotation therebetween so that said tubular member rotates the first portions for winding up spring means of the roll-up mechanism when the door is being unrolled, so that the first portions rotate said tubular member by action of the spring means unwinding when the door is being rolled up, and engaging second portions of the rotation means for rotation therewith, said second recess means being disposed in the second portions to prevent relative rotation therebetween so that said tubular member is rotated by the second portions for rolling up and unrolling the door;

second bulge means for:

rotating third portions of the roll-up mechanism therewith, said second bulge means being received in the third portions to prevent relative rotation therebetween to coact with said second recess means in the winding up and unwinding of the spring means, and engaging fourth portions of the rotation means for rotation therewith, said second bulge means being received in the fourth portions to prevent relative rotation therebetween to coact with said second recess means in the rolling up and unrolling of the door;

wall means having a non-circular configuration to supportingly provide the door with a substantially circular configuration when rolled up on said support roller in the opened position;

said tubular member having a one piece integral construction with said first and second recess means, said first and second bulge means and said wall means being a part of said one piece integral construction;

said wall means being formed by radii having different lengths to provide a smooth-non-circular curved outer wall surface extending longitudinally across an entire length of said tubular member;

a recess being provided in said tubular member, said recess extending longitudinally across the entire length of said tubular member, said first recess means being a concave outer surface of said recess disposed in an exterior side of said tubular member, said second recess means being a convex inner surface of said recess disposed on an interior side of said tubular member;

a bulge portion being provided on said tubular member, said bulge portion extending longitudinally across the entire length of said tubular member, said first bulge means being a convex outer surface of said bulge portion disposed on the exterior side of said tubular member, said second bulge means being a concave inner surface of said bulge portion disposed in the interior side of said tubular member; and said bulge portion being adjacent and parallel to said recess.

2. A support roller on which a door and the like is rolled up and unrolled between an opened position and a closed position, comprising:

an elongated tubular member having an opening extending longitudinally therethrough to receive a spring loaded roll-up mechanism therein for counterbalancing the weight of the door when the door is being rolled up to the opened position, and to also receive rotation means therein for rolling up and unrolling the door;

recess means for receiving a hinge portion of an uppermost slat of the door;

bulge means for engaging the uppermost salt and providing a surface for securing the uppermost slat thereto;

rail means for:

engaging first portions of the roll-up mechanism for rotation therewith, said rail means being disposed in the first portions to prevent relative rotation therebetween so that said tubular member rotates the first portions for winding up spring means of the roll-up mechanism when the door is being unrolled, and so that the first portions rotate said tubular member by action of the spring means unwinding when the door is being rolled up, and engaging second portions of the rotation means for rotation therewith, said rail means being disposed in the second portions to prevent relative rotation therebetween so that said tubular member is rotated by the second portions for rolling up and unrolling the door;

wall means having a non-circular configuration to supportingly provide the door with a substantially circular configuration when rolled up on said support roller in the opened position;

a number of flanges being securely mounted on said tubular member in a longitudinally spaced apart arrangement to support the door thereon when rolled up;

each of said flanges including a small tubular portion and a large tubular portion connected together by a side wall in a one piece integral construction; p1 first securement means for fixedly securing said small tubular portion of each of said flanges on an outer surface of said tubular member;

said large tubular portion of each of said flanges being provided with said recess means, said bulge means and said wall means;

said wall means of said large tubular portion of each of said flanges being formed by radii having different lengths to provide a smooth non-circular curved outer wall surface of said large tubular portion of each of said flanges;

said recess means of said large tubular portion of each of said flanges including a longitudinally extending recess provided in an outer wall of said large tubular portion of each of said flanges;

said bulge means of said large tubular portion of each of said flanges including a longitudinally extending bulge portion provided on said outer wall of said large tubular portion of each of said flanges;

said bulge portion of said large tubular portion of each of said flanges being adjacent and parallel to said recess associated therewith in said large tubular portion of each of said flanges;

said rail means including an elongated bar extending longitudinally across an entire length of said tubular member in an outward direction from an interior wall of said tubular member for being received in the first portions of the roll-up mechanism, and for also being received in the second portions of the rotation means; and second securement means for fixedly securing said elongated bar to said interior wall of said tubular member.

3. A roll-up device for rolling up a door to an opened position, and for unrolling the door to a closed position, comprising:

a tubular support roller for mounting the door thereon, a spring loaded roll-up mechanism for counterbalancing the weight of the door when the door is being rolled up to the opened position;

said roll-up mechanism including first shaft means for longitudinal positioning within the support roller with an end portion of said first shaft means extending out of an end of the support roller, a first collar rotatably mounted on said end portion of said first shaft means for securement to an end portion of the support roller, a second collar rotatably mounted on an opposite end portion of said first shaft means within the support roller, and a coil spring mounted on said first shaft means between said first and second collars, an inner end of said coil spring being secured to said second collar and an opposite end of said coil spring being secured to said first shaft means adjacent to said first collar;

said first shaft means, said first and second collars and said coil spring being assembled together as a first unit construction to permit said first unit construction to be inserted into the end of the support roller;

rotation means for rotating the support roller to roll up and unroll the door;

said rotation means including second shaft means for longitudinally positioning within the support roller with an end portion of said second shaft means extending out of an opposite end of the support roller, a third collar fixedly mounted on said end portion of said second shaft means for securement to an opposite end portion of the support roller, a fourth collar fixedly mounted on an opposite end portion of said second shaft means within the support roller, securement means fixedly securing said third and fourth collars to said second shaft means for rotation with said second shaft means;

said second shaft means, and said third and fourth collars being assembled together as a second unit construction to permit said second unit construction to be inserted into the opposite end of the support roller;

said opposite end portion of said first shaft means being longitudinally spaced from said opposite end portion of said second shaft means within the support roller;

first recess means for engaging the support roller to rotate said first and second collars therewith, said first recess means being provided in said first and second collars for receiving an inwardly projecting portion provided on an interior wall of the support roller to prevent relative rotation between said first and second collars and the support roller so that the support roller rotates said first and second collars for winding up said coil spring of said roll-up mechanism when the door is being unrolled and so that said first and second collars rotate the support roller by action of said coil spring unwinding when the door is being rolled up, while permitting longitudinal movement of said second collar within the support roller;

second recess means engaging the support roller for rotation therewith, said second recess means being provided in said third and fourth collars for receiving the inwardly projecting portion provided on the interior wall of the support roller to prevent relative rotation between said third and fourth collars and the support roller so that the support roller is rotated by said third and fourth collars for rolling up and unrolling the door;

said first recess means and said second recess means being in longitudinal alignment with each other to receive the inwardly projecting portion provided on the interior wall of the support roller; and edge means provided on each of said first, second, third and fourth collars for providing a smooth non-circular curved outer edge surface on each of said first, second, third and fourth collars to conform to the interior wall of the support roller, said outer edge surface of each of said first, second, third and fourth collars being formed by radii having different lengths;

whereby when the door is being rolled down by said rotation means, said first shaft means is held stationary while the support roller rotates said first and second collars so that said second collar winds up said coil spring on said first shaft means to a tensioned condition to counterbalance the weight of the door for when the door is rolled up to the opened position.

4. A roll-up device according to claim 3, wherein said second collar has a hole therethrough, said inner end of said coil spring passes through said second collar hole from one side thereof and is off-set on an opposite side of said second collar to maintain said inner end of said coil spring in said second collar hole.

5. A roll-up device according to clam 3, including projection means for additionally engaging the support roller to rotate said first and second collars therewith, said projection means being provided on said first and second collars adjacent to said first recess means, said projection means being received in a recess provided in the interior wall of the support roller to further prevent said relative rotation between said first and second collar and the support roller, while permitting said longitudinal movement of said second collar within the support roller.

6. A roll-up device according to claim 5, wherein said projection means includes a projection provided on an edge of each of said first and second collars for matingly engaging in the recess provided in the interior wall of the support roller.

7. A roll-up device according to claim 5, including second projection means for additionally permitting said third and fourth collars to rotate the support roller therewith, said second projection means being provided on said third and fourth collars adjacent to said second recess means, said second projection means being received in the recess provided in the interior wall of the support roller to further prevent said relative rotation between said third and fourth collars and the support roller.

8. A roll-up device according to claim 7, wherein said second projection means includes a projection provided on an edge of each of said third and fourth collars for matingly engaging in the recess provided in the interior wall of the support roller.

9. A roll-up device according to claim 3, wherein said first recess means includes a recess provided in an edge of each of said first and second collars for matingly receiving the inwardly projecting portion provided on the interior wall of the support roller, and said second recess means also includes a recess provided in an edge of each of said third and fourth collars for matingly receiving the inwardly projecting portion provided on the interior wall of the support roller.

10. A roll-up device according to claim 3, wherein a fifth collar identical to said second collar is rotatably mounted on said first shaft means within the support roller, and a second coil spring is mounted on said first shaft means, one end of said second coil spring being secured to said fifth collar and an opposite end of said second coil spring being secured to said first shaft means.

11. A roll-up device according to claim 3, including spring means for providing an increased counterbalancing force for said roll-up mechanism, said spring means being mounted on said first shaft means around said coil spring, said spring means including a second coil spring, an inner end of said second coil spring being also secured to said second collar, and an opposite end of said second coil spring being secured to said first shaft means adjacent to said first collar.

* * * * *